US007304262B2

(12) United States Patent
Stoving et al.

(10) Patent No.: US 7,304,262 B2
(45) Date of Patent: Dec. 4, 2007

(54) VACUUM ENCAPSULATION HAVING AN EMPTY CHAMBER

(75) Inventors: Paul N. Stoving, Oak Creek, WI (US); E. Fred Bestel, Minthill, NC (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/802,409

(22) Filed: Mar. 16, 2004

(65) Prior Publication Data

US 2005/0016963 A1 Jan. 27, 2005

Related U.S. Application Data

(60) Provisional application No. 60/465,269, filed on Apr. 25, 2003.

(51) Int. Cl.
*H01H 33/66* (2006.01)

(52) U.S. Cl. ..... 218/120; 218/138; 29/622

(58) Field of Classification Search ..... 218/7, 218/10, 42, 118–122, 134–140, 153–155; 29/622, 874, 592.1
See application file for complete search history.

(56) References Cited

U.S. PATENT DOCUMENTS 3,849,617 A * 11/1974 Pflanz ..... 218/118
4,124,790 A 11/1978 Kumbera et al.
4,150,270 A 4/1979 Zunick
4,168,414 A 9/1979 Kumbera et al.
4,568,804 A 2/1986 Luehring
5,597,992 A 1/1997 Walker
5,747,765 A 5/1998 Bestel et al.
5,917,167 A 6/1999 Bestel
6,331,687 B1 12/2001 Dunk et al.

OTHER PUBLICATIONS

PCT Notification Concerning Transmittal of Copy of International Preliminary Report on Patentability (Chapter 1 of the Patent Cooperation Treaty), mailed Nov. 10. 2005 (5 total pages).
Search Report from International Application No. PCT/US04/12803, dated Feb. 17, 2005.
Written Opinion from International Application No. PCT/US04/12803, dated Feb. 17, 2005.

* cited by examiner

*Primary Examiner*—Elvin Enad
*Assistant Examiner*—M. Fishman
(74) *Attorney, Agent, or Firm*—Fish & Richardson P.C.

(57) ABSTRACT

A vacuum assembly including a vacuum interrupter may be sealed with a compliant material and/or rubber plugs, so that a cavity is created and maintained within the assembly for use with a current exchange housing and/or bellows, during operation of the vacuum interrupter. During vacuum molding of the vacuum assembly to encapsulate the vacuum assembly in an epoxy, a resulting pressure differential caused by the vacuum molding is prevented from disturbing the seal around the vacuum assembly, by way of a needle or tube included in the seal. In this way, air from within the cavity is allowed to escape, while the epoxy is prevented from entering the cavity. Then, once encapsulation is complete, the vacuum assembly can be joined with an operating rod and other components to complete a vacuum switching device.

13 Claims, 5 Drawing Sheets

VACUUM ENCAPSULATION HAVING AN EMPTY CHAMBER

CLAIM OF PRIORITY

This application claims priority under 35 USC §119(e) to U.S. Provisional Application Ser. No. 60/465,269, filed on Apr. 25, 2003, the entire contents of which are hereby incorporated by reference.

TECHNICAL FIELD

This description relates to electrical switchgear, and, more particularly, to a vacuum interrupter encapsulation.

BACKGROUND

Conventional vacuum switchgear exists for the purpose of providing high voltage fault interruption. Examples of such vacuum switchgear include vacuum fault interrupters (also referred to as "vacuum interrupters" or "interrupters"), which generally include a stationary electrode assembly having an electrical contact, and a movable electrode assembly on a common longitudinal axis with respect to the stationary electrode assembly and having its own electrical contact. The movable electrode assembly generally moves along the common longitudinal axis such that the electrical contacts come into and out of contact with one another. In this way, vacuum interrupters placed in a current path can be used to interrupt extremely high current, and thereby prevent damage to an external circuit.

Such a vacuum interrupter may be encapsulated in a rigid or semi-rigid structure that is designed to provide insulation to the interrupter. The rigid structure may be designed to encapsulate one or more air cavities, in addition to the vacuum interrupter and related components. The air cavities may be used to facilitate construction and/or operation of the vacuum interrupter and its encapsulating structure. For example, such an air cavity may provide space for movement of various components, or may allow thermal expansion of one or more materials associated with making or using the vacuum interrupter.

SUMMARY

In one general aspect, a vacuum switching device includes a vacuum interrupter, a current exchange housing adjacent to the vacuum interrupter, a seal provided around the vacuum interrupter and the current exchange housing so as to define a cavity within the current exchange housing and adjacent to the vacuum interrupter, and a tube provided within the seal, the tube disposed such that a first end of the tube accesses the cavity and a second end of the tube accesses an exterior of the seal.

Implementations may include one or more of the following features. For example, the tube may include a syringe needle inserted through the seal. The tube may be integrally formed into the seal during formation of the seal.

The second end of the tube may be open to an encapsulation material provided around the vacuum interrupter, the current exchange housing, and the seal. In this case, the encapsulation material may include a pre-filled, hot-curing, two-component epoxy resin.

Also, a diameter of the tube may be selected such that air within the cavity is permitted to escape from the cavity to the exterior of the seal during a molding process that involves injection of the encapsulation material in liquid form into a reduced-pressure space surrounding the vacuum interrupter, the current exchange housing, and the seal. In this case, the diameter of the tube may be selected such that the encapsulation material in liquid form will not travel from the exterior of the seal to the cavity during the injection.

The vacuum switching device may include an operating rod that extends through the seal into the cavity, and is operable to actuate the vacuum interrupter.

In another general aspect, a seal is provided around a vacuum interrupter and an air-filled cavity. A tube provided within the seal has a first end that accesses the air-filled cavity and a second end that accesses an exterior of the seal. The seal, the vacuum interrupter, and the air-filled cavity are encapsulated.

Implementations may include one or more of the following features. For example, in encapsulating the seal, the vacuum interrupter, and the air-filled cavity, an air pressure in an area of the exterior of the seal may be reduced, such that air from within the air-filled cavity is removed from the air-filled cavity through the tube.

During encapsulation, the seal, the vacuum interrupter, and the air-filled cavity may be placed into a mold that contains a space that is in contact with the exterior of the seal. Air may be removed from the space that is in contact with the exterior of the seal, epoxy may be injected into the space in liquid form, and the mold may be removed after the epoxy is cured.

To remove air from the space, a pressure differential between the air-filled cavity and the space may be reduced by allowing a transfer of air from the air-filled cavity through the tube.

In removing the mold, a mold core may be removed along with the mold, and an operating rod for activation of the vacuum interrupter may be inserted into a cavity left by removal of the mold core. In providing the seal, the air-filled cavity may be sealed against the mold core while epoxy is injected into the space that is in contact with the exterior of the seal.

The tube may be selected to have a diameter that allows air from the air-filled cavity to escape into the space that is in contact with the exterior of the seal, and that prevents the liquid-form epoxy from traveling between the space that is in contact with the exterior of the seal and the air-filled cavity.

To provide the seal, a compliant material may be provided around the vacuum interrupter and the air-filled cavity, and a plug may be provided adjacent to the compliant material, with the plug positioned to seal the air-filled cavity. To provide the tube within the seal, the tube may be provided through the plug.

In another general aspect, a vacuum switching device includes a vacuum interrupter, a hollow housing adjacent to the vacuum interrupter, a seal provided around the vacuum interrupter and the hollow housing to define an air-filled cavity within the hollow housing, and means for reducing a pressure differential between the air-filled cavity and a space exterior to the seal during a vacuum gelation process in which air pressure in the space is reduced for injection of a liquefied encapsulation material into the space, such that the integrity of the seal is maintained during the vacuum gelation process.

Implementations may include one or more of the following features. For example, the means for reducing a pressure differential may include an air passageway from the air-filled cavity to the space exterior to the seal, or may include a tube inserted through the seal between the air-filled cavity and the exterior space. In the latter case, the tube may have a diameter large enough to reduce the pressure differential by transferring air from the air-filled cavity to the space exterior to the seal during the vacuum gelation process, and small enough to prevent transmission of the liquefied encapsulation material from the space into the air-filled cavity.

The details of one or more implementations are set forth in the accompanying drawings and the description below. Other features will be apparent from the description and drawings, and from the claims.

DETAILED DESCRIPTION

Figure 1:
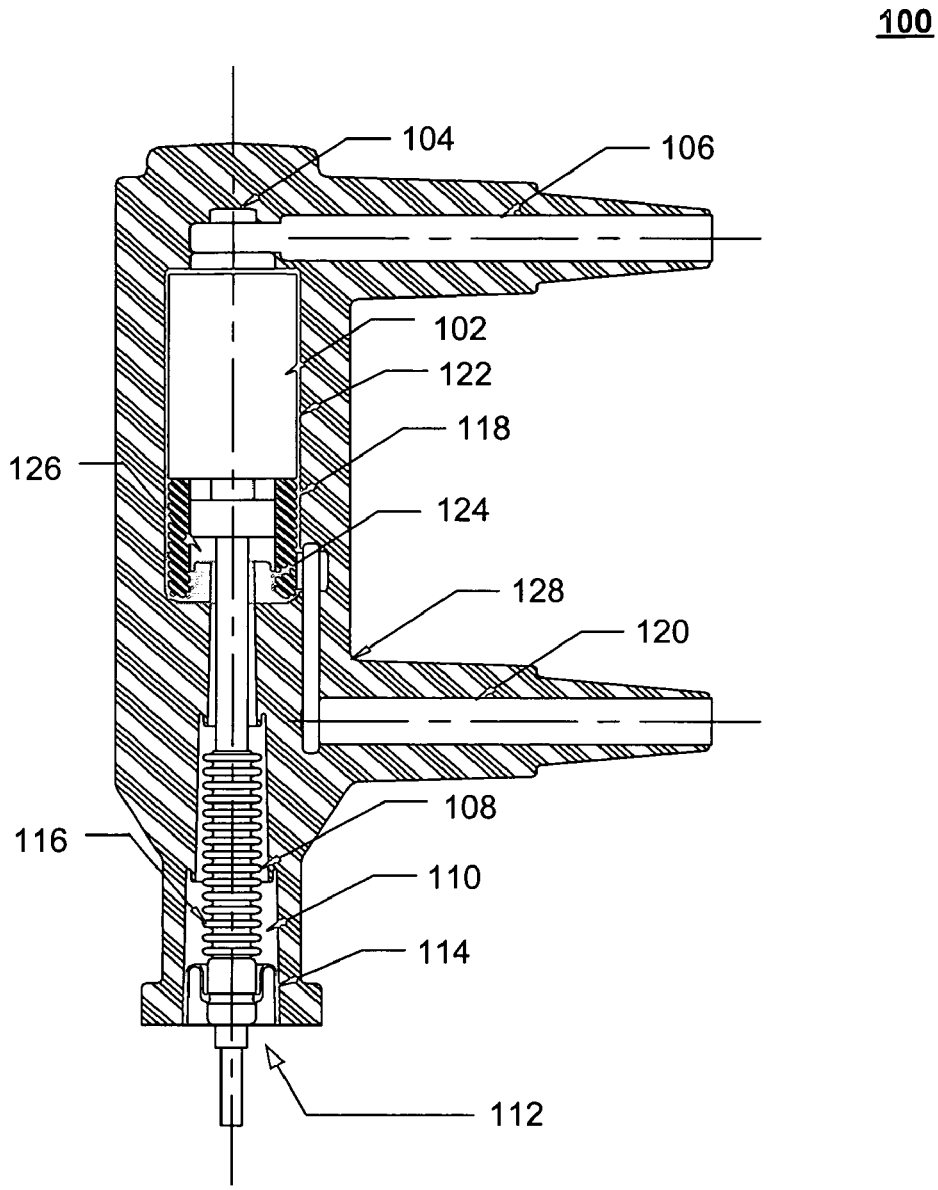
FIG. 1 is a cutaway side view of a vacuum switching device.

FIG. 1 shows a vacuum switching device 100 that includes a vacuum fault interrupter 102 that may be used to protect an external circuit (not shown) from excessively high current. The vacuum interrupter 102 includes a stationary terminal rod 104 that is connected to an upper contact terminal 106. The upper contact terminal 106 allows a connection of the vacuum interrupter 102 to the external circuit.

The vacuum interrupter 102 is affixed to an operating rod 108 that is contained within a dielectric-filled cavity 110 (the dielectric, not shown in FIG. 1, may be gaseous or liquid) and extends through an opening 112. The opening 112 is sealed around the operating rod 108 by way of a sealing diaphragm 114. The operating rod 108 is wrapped within a silicone rubber sleeve or skirt 116. As shown, circumferential ribs are included along the length of silicone rubber skirt 116 in order to increase the "creep distance" (length of insulating surface) so as to help prevent debilitating short circuits and to improve dielectric properties of the operating rod 108 and associated elements.

The operating rod 108 is connected at an end extending through the opening 112 to an external device (not shown) operable to cause axial movement thereof. At its other end, the operating rod 108 is connected to a movable electrical contact within the vacuum interrupter 102. As a result, the movable electrical contact may be moved into or out of contact with a stationary electrical contact within the vacuum interrupter 102 (interior of vacuum interrupter not shown). In this way, a flow of current within the vacuum interrupter 102 may be interrupted when necessary to protect the external circuit.

A current exchange is housed within a current exchange housing 118, and permits current flow between the vacuum interrupter 102 and a conductor 120. In general, such an assembly facilitates current flow between two points and may include, for example, a roller contact, a sliding contact, or a flexible connector. Although not explicitly shown in FIG. 1, the actuation end of the vacuum interrupter 102 also includes a bellows that permits motion of the moving contact while still maintaining a vacuum seal.

A compliant material 122, which may be, for example, a silicone rubber sleeve, encases the vacuum interrupter 102. In one implementation, the compliant material 122 is adhered to the vacuum interrupter 102 by, for example, a silane-based adhesive such as SILQUEST A-1100 silane (that is, gamma-aminopropyl triethoxysilane). In addition to encasing the vacuum interrupter 102, the compliant material 122, in conjunction with at least one rubber plug 124, defines an air cavity 126 within the current exchange housing 118. This cavity 126 is used to allow motion of the operating rod 108 during operation of the vacuum interrupter.

A rigid encapsulation material 128, which may be, for example, an epoxy encapsulation material, is used to enclose the whole of the vacuum switching device 100 of FIG. 1. In one implementation, the epoxy encapsulation 128 is cast from a cycloaliphatic, pre-filled, hot-curing, two-component epoxy resin.

The compliant material 122 also is used to cushion the different coefficients of linear thermal expansion between the vacuum interrupter 102 and the encapsulation epoxy 128. In order to perform this function effectively, the compliant material 122 requires a mechanical escape (i.e., a region where the compliant material 122 comes into contact with air, e.g., in the cavity 126).

Figure 2:
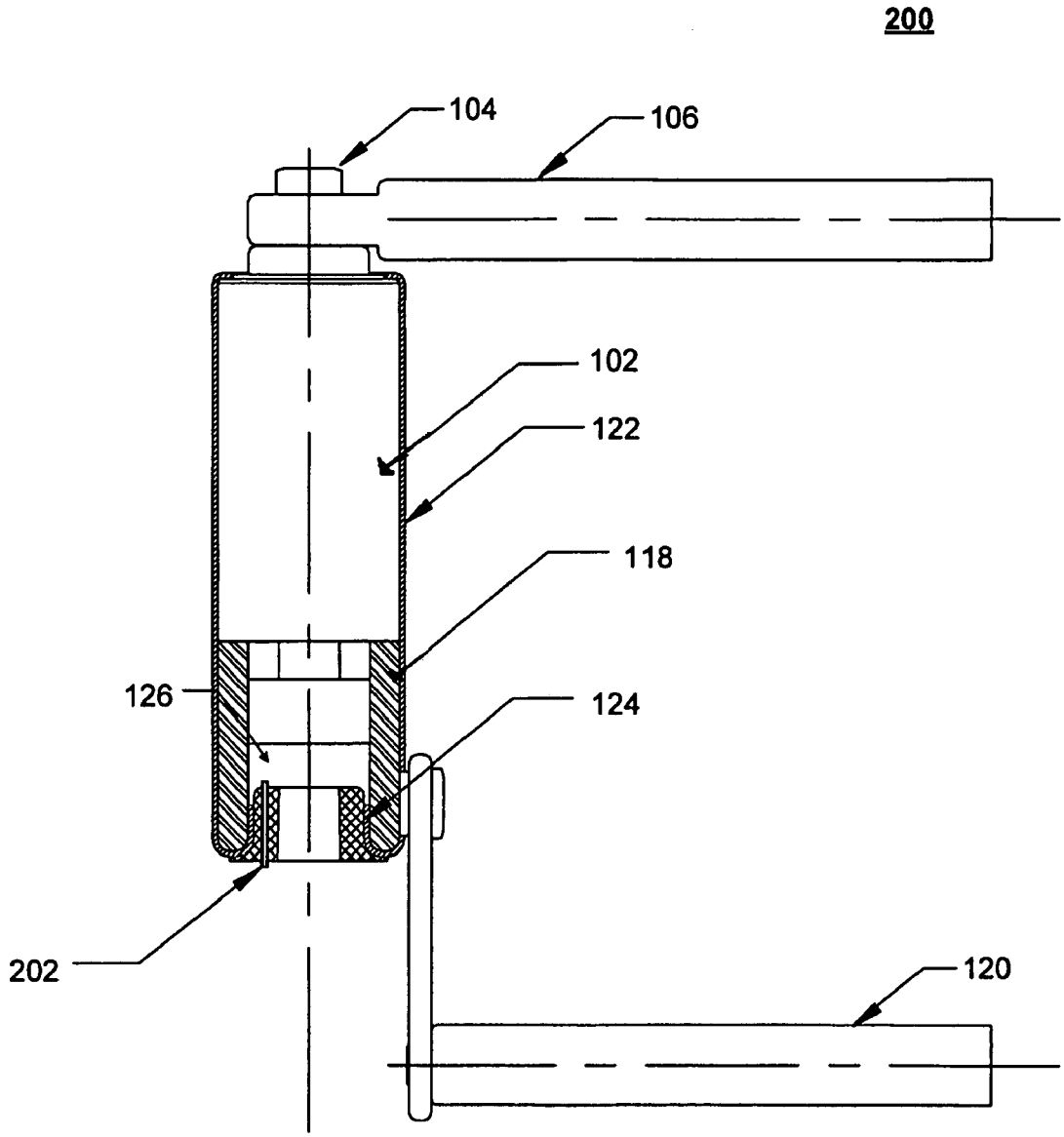
FIG. 2 is a magnified view of a vacuum assembly of the device of FIG. 1.

FIG. 2 is a magnified view of a vacuum assembly 200 of FIG. 1. The vacuum assembly 200 generally refers to portions of the vacuum switching device 100 of FIG. 1 placed within a mold during a formation of the epoxy encapsulation 128. The vacuum assembly 200 includes the vacuum interrupter 102, the stationary terminal rod 104, the upper contact terminal 106, the current exchange housing 118, the compliant material 122 and the rubber plug 124.

During formation of the epoxy encapsulation 128, as explained in more detail below, a vacuum is formed between the vacuum assembly 200 and a mold into which epoxy will be injected for forming the epoxy encapsulation 128. During this process, the compliant material 122, along with, e.g., the rubber plug 124, may form at least part of a seal that will prevent epoxy from filling the cavity 126 within the current exchange housing 118. In this way, the current exchange and bellows are protected from the injected epoxy.

However, as a result of this sealing, air cannot be pumped out of the region that will form the cavity 126. As a result, a pressure differential between the vacuum within the mold (i.e., external to the vacuum assembly 200) and the air in the sealed-off cavity 126 may cause various difficulties. For example, the pressure differential may cause the compliant material 122 to inflate away from the vacuum interrupter 102 and the current exchange housing 118 like a balloon, or may blow out some of the rubber plug 124. Such problems may cause difficulties with the encapsulation process, and may result in, for example, poor insulation of the vacuum interrupter, cracks or voids in the epoxy encapsulation, or epoxy leaking into the current exchange area (which may prevent operation of the vacuum interrupter).

To avoid these difficulties, including, for example, inflation or seal blow-out, one or more small needles or capillary tubes 202 are pushed through or molded into a portion of the rubber plug 124 that helps seal the vacuum interrupter assembly 200. In one implementation, an inside diameter of the needle 202 or tube is such that air can be removed from the sealed cavity 126, so as to prevent the air pressure differentials, while being small enough that epoxy can not flow through the needle or tube 202 without curing (thus sealing the tube off and preventing epoxy from filling the cavity 126 and other portions of the assembly that are to be kept free of epoxy). For example, a diameter of the needle or tube 202 may be approximately 0.010 inches, or needles may be used having a gauge in the range of 23-26, so that an inner diameter of such needles ranges from approximately 0.25-0.35 mm.

Although FIG. 2 illustrates only one needle 202 within the rubber plug, it should be understood that a number and placement of needles may be optimally selected for the vacuum assembly at hand. For example, in one implementation, four needles may be symmetrically placed around a center axis of the vacuum assembly. In another implementation, the compliant material may be extended to serve the function of the rubber plug 124; in this implementation, the rubber plug 124 may not be necessary, and the needle(s) 202 may be placed directly into the compliant material 122.

Figure 3:
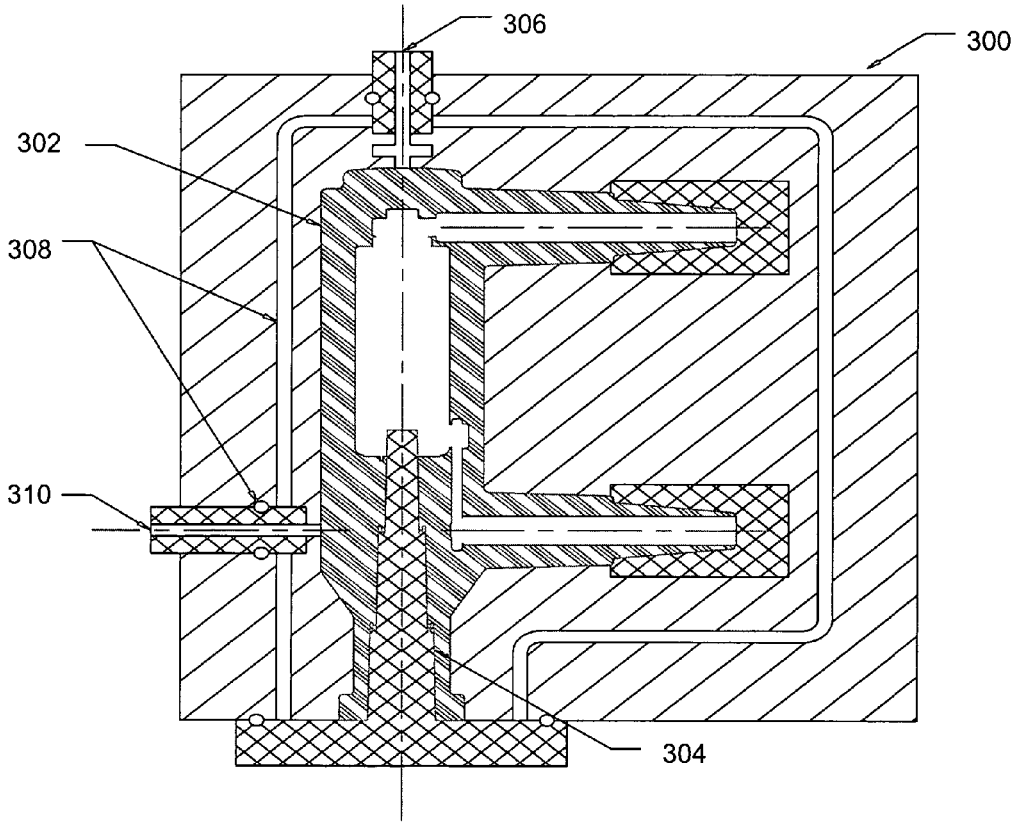
FIG. 3 is a cross-section of a mold used to form an epoxy encapsulation around the vacuum assembly of FIG. 2.

FIG. 3 is a cross-section of a mold used to form an epoxy encapsulation around the vacuum assembly 200 of FIG. 2. Initially, the vacuum assembly 200 is placed within the mold 300. For example, FIG. 3 may represent one symmetrical half of the mold 300, so that, by separating the mold into its two symmetrical halves, the vacuum assembly 200 may easily be placed within the mold 300.

The mold 300 includes a space 302 that is to be filled with the epoxy encapsulation 128. A mold core 304 extends upward into the space 302, in order to define the cavity 110 into which the operating rod 108 is inserted. The mold core 304, in one implementation, seals against the bottom of the current exchange housing 118. In this way, epoxy is prevented from filling the bellows and the cavity 126 within the current exchange housing 118, thus allowing these components to continue to be free to move in the epoxy encapsulation.

Prior to molding, a vacuum port 306 removes air from the space 302, which is sealed by vacuum seals 308. Then, a fill port 310 is used to inject epoxy, at high heat and in liquid form, into the space 302. Subsequently, the epoxy is allowed to cure into the epoxy encapsulation 128, and the mold 300 is removed. This molding process is generally known as vacuum gelation.

As referred to above, removal of air from the space 302 through the vacuum port 306 may create a pressure differential between the air within the air cavity 126 and the vacuum created within the space 302, so that the compliant material 122 and rubber plug 124 may be detrimentally affected. The presence of the needle 202 prevents such a pressure differential, while ensuring that epoxy does not get into the air cavity 126.

Figure 4:
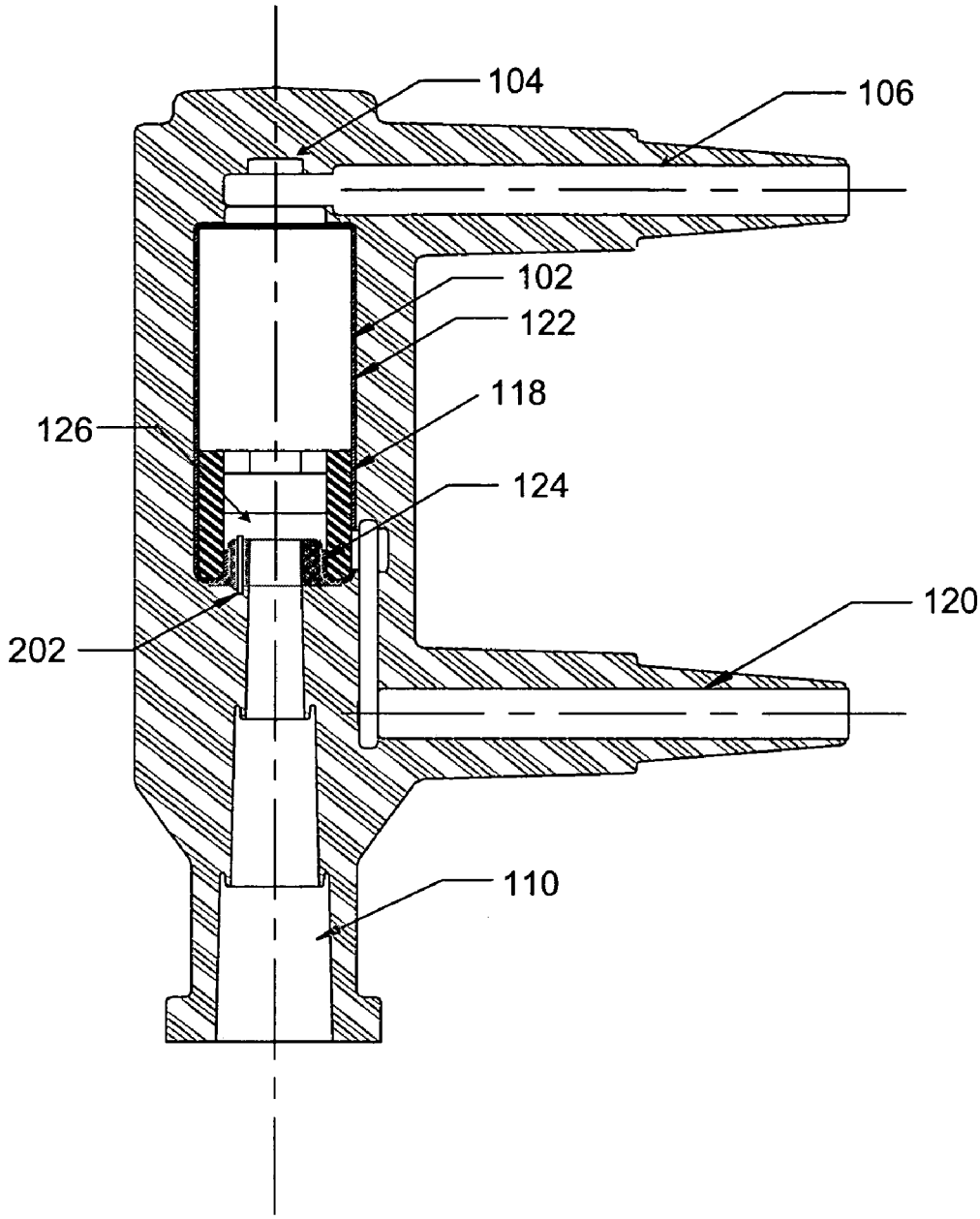
FIG. 4 is a cross section of the encapsulated vacuum assembly.

FIG. 4 is a cross section of the encapsulated vacuum assembly 200 and illustrates the vacuum assembly after the molding process is complete, the epoxy encapsulation 128 has cured, and the mold 300 and mold core 304 have been removed.

As shown in FIG. 4, the space 110 is created by removal of the mold core 304, so that the operating rod 108 and associated portions may be inserted in their place for completion of the vacuum switching device of FIG. 1, including placement of the seal 114. It should be understood with respect to FIGS. 2 and 4 that a relative size of the needle 202 is exaggerated with respect to remaining portions of the vacuum assembly. Thus, with respect to FIG. 1, it should be understood that the needle 202 is included within the rubber plug 124, but is not visible in FIG. 1 due to its relative size.

Figure 5:
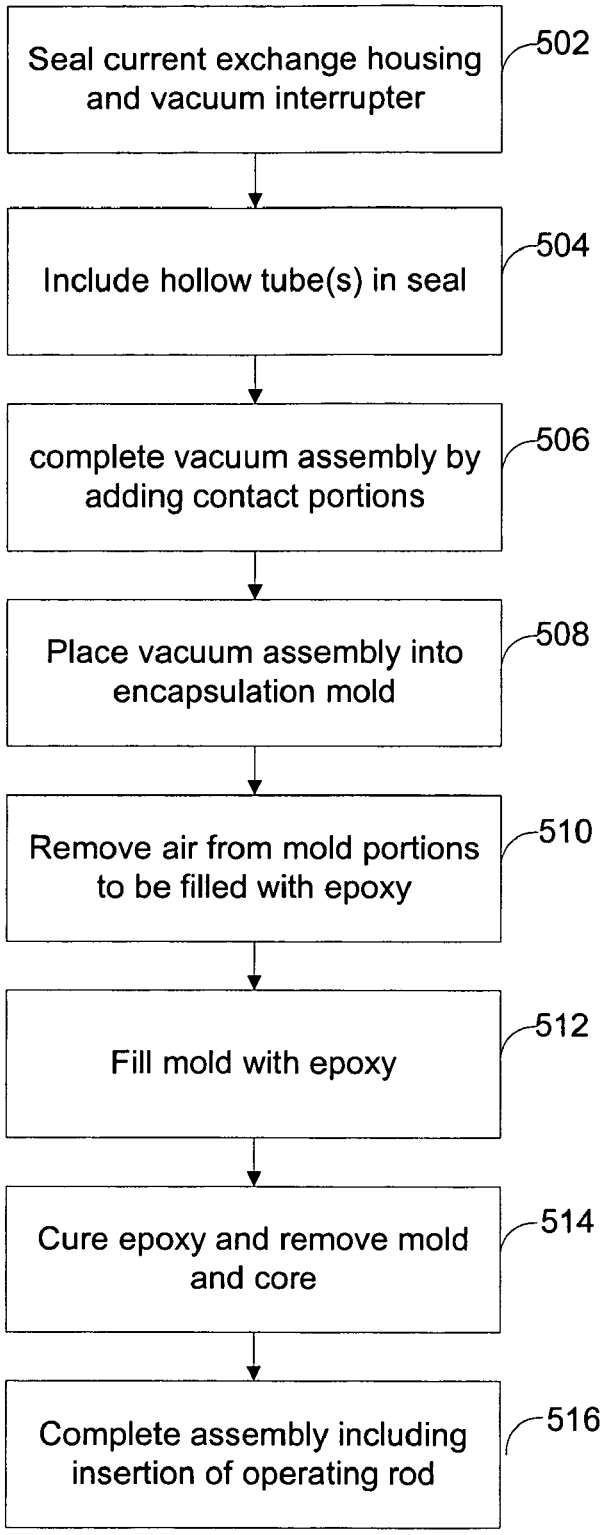
FIG. 5 is a flowchart illustrating a process for forming the vacuum switching device of FIG. 1.

FIG. 5 is a flowchart 500 illustrating a process for forming the vacuum switching device of FIG. 1. In FIG. 5, the process begins with the sealing of the vacuum interrupter 102 and the current exchange housing 118 using the compliant material 122 (502). Then, the needle(s) 202 are inserted into this seal (504). Of course, the needle(s) 202 also may be formed into the seal as part of, or prior to, the sealing process.

Then, the contact portions 104, 106, and 120 are attached to the sealed vacuum interrupter 102 and current exchange housing 118 to complete the vacuum assembly 200 (506). The vacuum assembly 200 is placed into the mold 300 (508), and the air is removed from the space 302 within the mold 300 (510) to create a vacuum. Then, epoxy is injected into the mold 300 (512).

As already explained, the presence of needles 202 prevent any pressure differential from being created between the space 302 and the cavity 126 so that the seal around the vacuum interrupter 102 and the current exchange housing 118 is not disturbed. At the same time, diameters of needles 202 are small enough that any epoxy incidentally entering the needles 202 is cured before the epoxy can reach the cavity 126. As a result, the needles 202 prevent a pressure differential from forming as the vacuum is pulled on the mold 300, with the number of the needles 202 being directly proportional to the rate at which air is removed from the cavity 126, and inversely proportional to the pressure differential. By a time that epoxy 128 has been fully injected into the mold 300, any air within the cavity 126 has been substantially removed, and the needles 202 are plugged with cured epoxy, so as to prevent the epoxy from filling the cavity 126.

Once the epoxy is cured and the mold 300 and the mold core 304 are removed (514), assembly of the vacuum switching device 100 may be completed by placing the operating rod 108 and associated components into the space 110 created by the mold core 304 (516).

As explained above, a vacuum assembly including a vacuum interrupter may be sealed with a compliant material and/or rubber plugs, so that a cavity is created and maintained within the assembly for use with a current exchange housing and/or bellows during operation of the vacuum interrupter. During vacuum molding of the vacuum assembly to encase the vacuum assembly in epoxy, a resulting pressure differential caused by the vacuum molding is prevented from disturbing the seal around the vacuum assembly, by way of a needle or tube included in the seal. In this way, air from within the cavity is allowed to escape, while the epoxy is prevented from entering the cavity. The vacuum assembly than can be joined with an operating rod and other components to complete a vacuum switching device.

A number of implementations have been described. Nevertheless, it will be understood that various modifications may be made. Accordingly, other implementations are within the scope of the following claims.

What is claimed is:

1. A vacuum switching device comprising:

a vacuum interrupter;

a current exchange housing adjacent to the vacuum interrupter;

a seal provided around the vacuum interrupter and the current exchange housing so as to define a cavity within the current exchange housing and adjacent to the vacuum interrupter; and a capillary tube provided through the seal, the capillary tube disposed such that a first end of the capillary tube accesses the cavity and a second end of the capillary tube accesses an exterior of the seal.

2. The vacuum switching device of claim 1 wherein the capillary tube comprises a syringe needle inserted through the seal.

3. The vacuum switching device of claim 1 wherein the capillary tube is integrally formed into the seal during formation of the seal.

4. The vacuum switching device of claim 1 wherein the second end of the capillary tube is open to an encapsulation material provided around the vacuum interrupter, the current exchange housing, and the seal.

5. The vacuum switching device of claim 4 wherein the encapsulation material includes a pre-filled, hot-curing, two-component epoxy resin.

6. The vacuum switching device of claim 1 comprising an operating rod extending through the seal into the cavity, and operable to actuate the vacuum interrupter.

7. A vacuum switching device comprising:

a vacuum interrupter;

a hollow housing adjacent to the vacuum interrupter;

a seal provided around the vacuum interrupter and the hollow housing, the seal defining an air-filled cavity within the hollow housing; and a tube provided through the seal and including cured liquefied encapsulation material within the tube to block the passage of air between an exterior of the seal and the cavity.

8. The vacuum switching device of claim 7 wherein the tube comprises a syringe needle inserted through the seal.

9. The vacuum switching device of claim 7 wherein:

the tube is disposed such that a first end of the tube accesses the cavity and a second end of the tube access an exterior of the seal, and the second end of the tube is open to a second encapsulation material provided around the vacuum interrupter, the hollow housing, and the seal.

10. The vacuum switching device of claim 9 wherein the second encapsulation material includes a pre-filled, hot-curing, two-component epoxy resin.

11. The vacuum switching device of claim 7 comprising an operating rod extending through the seal into the cavity, and operable to actuate the vacuum interrupter.

12. The vacuum switching device of claim 1 wherein the capillary tube has an inner diameter of approximately 0.25 to 0.35 mm.

13. The vacuum switching device of claim 1 wherein the capillary tube has a gauge from 23 to 26.

* * * * *